United States Patent [19]

Reiter

[11] Patent Number: 4,964,243

[45] Date of Patent: Oct. 23, 1990

[54] VACUUM POLE SANDER

[76] Inventor: John P. Reiter, 10407 Quebec Ave. South, Bloomington, Minn. 55438

[21] Appl. No.: 377,262

[22] Filed: Jul. 10, 1989

[51] Int. Cl.[5] ..... B24B 23/00; B24B 55/06; B24B 15/00

[52] U.S. Cl. ..... 51/180; 51/273; 51/392

[58] Field of Search ..... 51/170 R, 170 T, 170 TL, 51/391, 392, 393, 386, 180, 273

[56] References Cited

U.S. PATENT DOCUMENTS

| | | | |
|---|---|---|---|
| 3,183,638 | 5/1985 | Hutchins | 51/386 |
| 3,935,678 | 2/1976 | Marton | 51/170 T |
| 4,062,152 | 12/1977 | Mehrer | 51/170 R |
| 4,516,361 | 5/1985 | Gringer | 51/392 |
| 4,697,389 | 10/1987 | Romine | 51/180 |
| 4,759,155 | 7/1988 | Shaw | 51/392 |
| 4,779,385 | 10/1988 | Reiter | 51/180 |

*Primary Examiner*—Frederick R. Schmidt

*Assistant Examiner*—Bruce P. Watson

*Attorney, Agent, or Firm*—Haugen and Nikolai

[57] ABSTRACT

A sanding device for working with gypsum board (sheetrock) and which may be coupled to a vacuum cleaner to reduce the dust problem created when sanding the joint cement. The sanding device comprises a sanding head having a generally rectangular planar base with a pattern of pedestals formed thereon for supporting the abrasive material. The base defines a vacuum plenum having ports therethrough for placing the channels between adjacent pedestals in fluid communication with the vacuum chamber. The head member is configured to attach by a universal joint to an elongated tubular pole whereby the workmen can manipulate the sanding head high on a wall or ceiling from a position on the floor. The vacuum cleaner is connectable to the free end of the pole and a suitable hose connection is made between the hollow interior of the tubular pole to the vacuum chamber of the sanding head.

6 Claims, 2 Drawing Sheets

VACUUM POLE SANDER

BACKGROUND OF THE INVENTION

I. Background of the Invention:

This invention relates generally to an improved device for creating smooth joints between sheets of gypsum-type wallboard, and more particularly to an improved gypsum board sanding tool incorporating a dust collecting feature.

II. Discussion of the Prior Art:

In my earlier U.S. Pat. No. 4,779,385, there is disclosed a pole sander of the type involved herein in which a hollow tubular pole provides the conduit through which a vacuum may be drawn creating a negative pressure through and around the base and side surfaces of a sanding head. The sanding head is fastened to the pole by means of a universal joint and a flexible, air impervious boot is made to surround the universal joint and the lower end portion of the pole. A somewhat similar configuration is discussed in the Mehrer U.S. Pat. No. 4,062,152.

My earlier construction was found to exhibit certain drawbacks. More particularly, with only a single central opening through the back of the vacuum chamber, a lack of uniformity in the amount of vacuum developed over the working face and edges of the sanding head has been observed. Moreover, being disposed in the fluid path, the universal joint is exposed to all of the dust and debris being drawn through the sanding head and the tubular pole to the vacuum cleaning attachment. The buildup of dust and debris in the universal joint was found to prematurely wear that joint because of the abrasive properties of that dust.

It has also been found that the accordian-pleated boot used to surround the U-joint and to provide a air-tight seal between the sanding head's vacuum chamber and the interior of the hollow pole tended to be overly flexible allowing the sanding head to flip and flop about too freely, making it somewhat difficult to maintain the desired surface contact between the abrasive sheet and the wall being treated.

The device of the Mehrer patent suffers from a further drawback in not adequately providing a fluid path between the perimeter of the sanding head and the vacuum chamber. As such, only the dust and debris developed over the planar surface of the sanding head is picked up and that surrounding the perimeter falls free.

SUMMARY OF THE INVENTION

Like my earlier gypsum board sanding apparatus, the present invention is directed to a sanding tool for smoothing and finishing the plaster joints between sheetrock panels such that the amount of dust developed which would otherwise permeate the area is collected in a vacuum cleaner. In accordance with the present invention, there is provided a flat, planar base member having first and second vacuum ports formed through the thickness dimension thereof at predetermined spaced-apart locations. The base member includes four mutually perpendicular side edges which fit about a planar, rigid, air-distribution member to yield a vacuum chamber. The air-distribution member includes a pattern of apertures extending through it. Suitably attached to the outside surface of the air-distribution member is an array of raised pedestals, all of equal height, and located so as to define interconnected channels leading from the periphery of the air-distribution member to the pattern of apertures. An elongated tubular pole having an open end and a closed end is joined to the planar base member by a suitable universal joint which permits the sanding head to be positioned over a wide range of angles relative to the axis of the elongated pole. Formed through the wall of the pole proximate its lower end are a pair of side ports. Flexible hoses are then used to couple those side ports on the pole to the vacuum ports formed on the base member. The hoses, while flexible, are sufficiently rigid to restrain free movement of the base member relative to the tubular pole and, moreover, provide a fluid path from the interior of the vacuum chamber to the interior of the tubular pole.

The hoses also bypass the U-joint so that, unlike my earlier embodiment described in U.S. Pat. No 4,779,385 and the arrangement shown in the Mehrer Pat. No. 4,062,152, the universal joint is not in the path of flow of the dust created during the sanding operation.

DESCRIPTION OF THE PREFERRED EMBODIMENT

Figure 1:
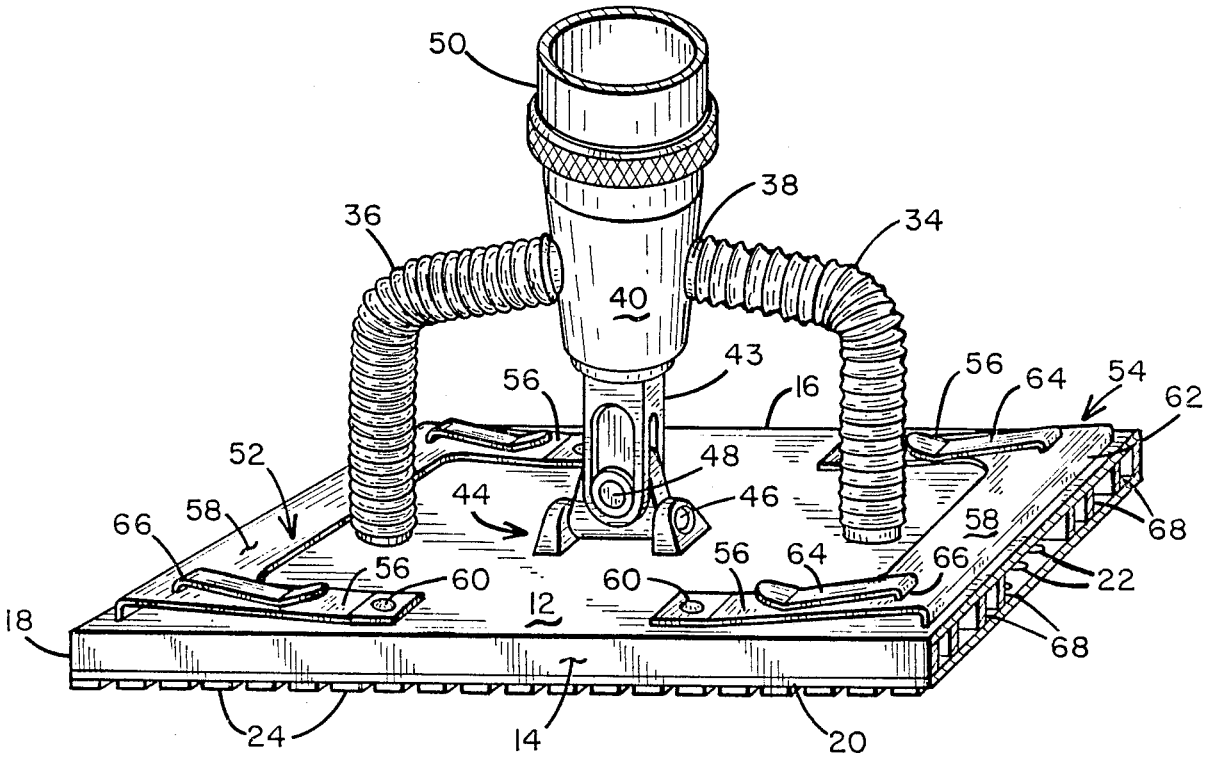
FIG. 1 is a perspective drawing of the sanding head portion of the pole sander of the present invention.
Figure 2:
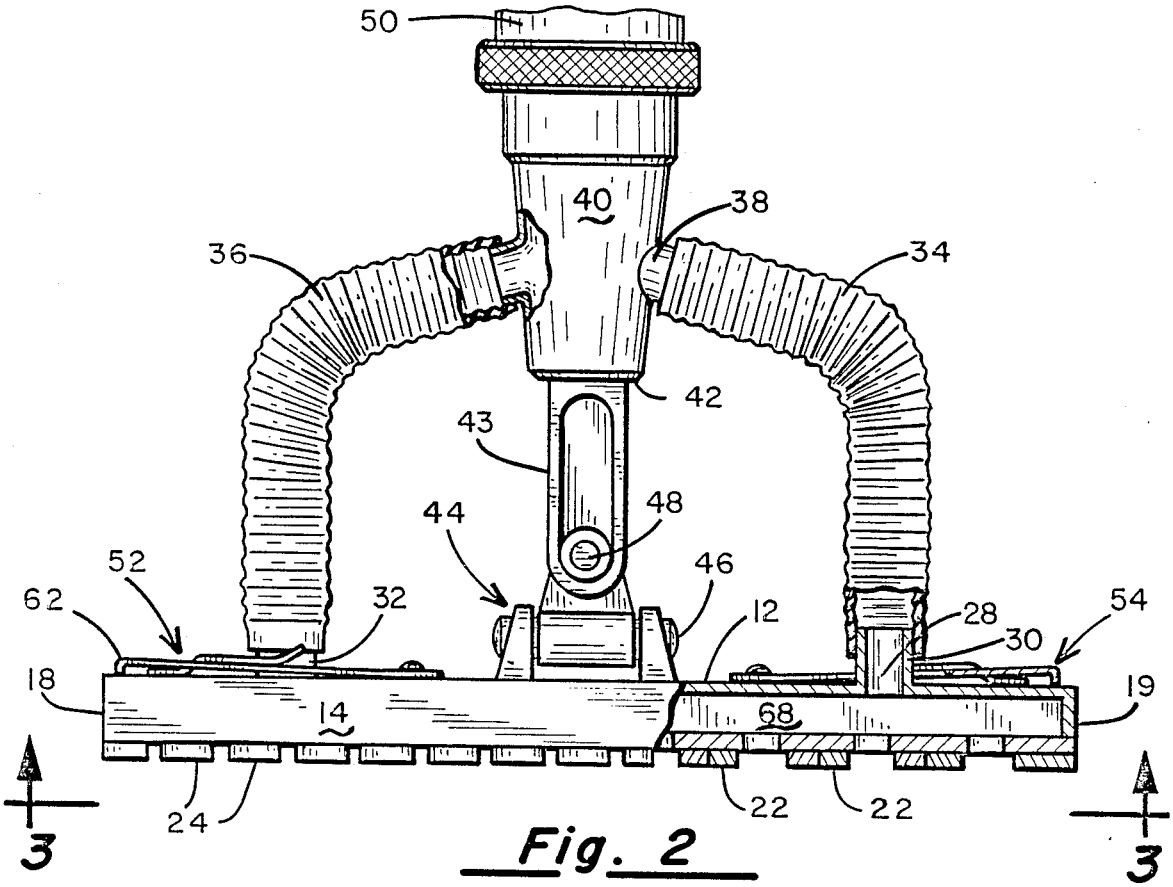
FIG. 2 is a partially cross-section side view of the pole sander.
Figure 3:
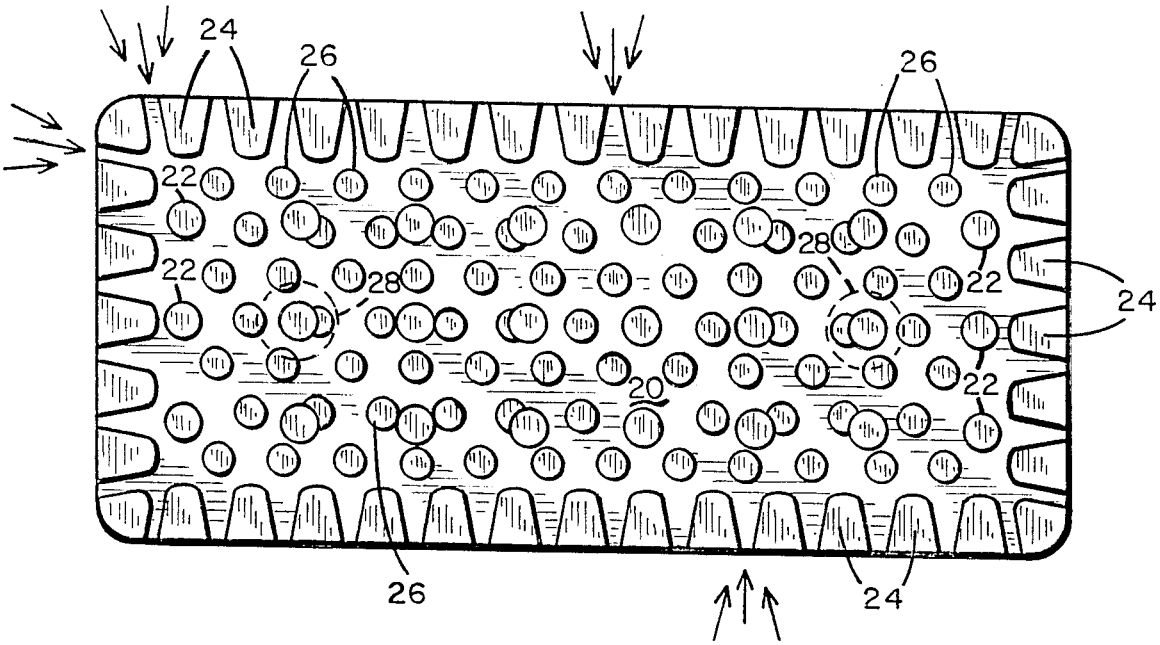
FIG. 3 is a view of the sanding head taken along the lines 3—3 in FIG. 2.

As is plainly illustrated in the views of FIGS. 1 through 3, the vacuum sander in accordance with the present invention includes a generally rectangular base member 12 having four mutually perpendicular downwardly depending side walls as at 14, 16 and 18. The remaining side wall 19 (FIG. 2) has been cut away in the drawing to better illustrate the interior of the base member 12.

Affixed to the lower edge surfaces of the four side walls 14, 16, 18, 19 and extending parallel to the base member 12 is a rigid, rectangular, generally planar, air-distribution member 20. As best illustrated in FIG. 3, the air-distribution member 20 includes a plurality of apertures as at 22 arranged in rows and columns and spread rather uniformly over the planar surface of the member 20.

Secured to the exposed underside of the air-distribution member 20 about its peripheral edges are a plurality of pedestals, as at 24, which are of equal height and which provide spaces therebetween defining a plurality of channels. Further cylindrical pedestals as at 26 are distributed over the surface of the air-distribution member 20 such that a piece of abrasive sheet material (not shown) when draped over the underside of the pedestals 24 and 26 will be spaced apart slightly from the matrix of apertures 22.

Referring again to FIGS. 1 and 2, it is to be observed that first and second spaced-apart vacuum ports, as at 28, pass through the thickness dimension of the base member 12 and surrounding those two ports are tubular stubs 30 and 32. Flexible, accordian-pleated hoses 34 and 36 are fitted over these respective stubs and are joined at their other end to similar tubular stubs 38 passing through the wall of a tubular coupling member 40. The hoses 34 and 36 are preferrably fabricated from a flexible plastic material reinforced with a helical wire and of sufficient stiffness to limit or control the base member 12 from flip-flopping relative to the pole.

The coupling member 40 is closed to air flow at its base 42 and a universal joint, indicated generally by numeral 44 is used to fasten the tubular coupler 40 to the upper surface of the base member 12. The universal joint is of conventional design and includes two orthogonally disposed axes 46 and 48 to allow the angle between the coupler sleeve 40 and the base member 12 to be continuously adjustable over a predetermined range. An elongated tubular pole 50 may be received in the coupler 40 either with a friction fit or by a threaded connection.

To hold the abrasive sheet (not shown) taut over the undersurface of the pedestals 24 and 26, a suitable clamping means, as at 52 and 54, are provided. As best seen in FIG. 1, these clamps preferably comprise a sheet of spring steel cut so as to be generally U-shaped, with parallel legs 56 and a cross portion 58 connected between them. The legs 56 are fastened to the base member by screws or rivets, such as at 60, such that a bent vertical edge 62 of the clamp members is normally urged tightly against the upper surface of the base member 12. Levers, as at 64, are inserted through slots 66 formed in the U-shaped clamping plates before those plates are fastened to the base member. The levers are arranged such that when the exposed portion thereof is lifted upward relative to the base member, it serves to also pry the vertical edge 62 of the spring plate away from the base member so that an abrasive sheet may be slipped between the two. When the lever is again released, the clamping force of the spring plate holds the abrasive sheet against movement during the sander's use.

With continued reference to FIG. 1, the right end edge 19 of the base member 12 is broken away to better illustrate the way in which reinforcing ribs on the air-distribution member 20 function to prevent the air-distribution member from deforming into the interior of the vacuum chamber as sanding pressure is applied between the pole sander head and the surface being finished. More particularly, a series of ribs, as at 68, are integrally formed with the air-distribution member 20 and extend parallel to one another over the length dimension of the sanding head. The height of the ribs is such that the air-distribution member 20 is maintained in parallel, spaced relationship with respect to the surface of the base member 12.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. Sanding apparatus comprising:

(a) a sanding head including (i) a generally rectangular planar base member having first and second vacuum ports formed through the thickness dimension thereof at spaced-apart locations on either side of a transversely extending center line, said base member having four mutually perpendicular side edges;

(ii) a rectangular planar, rigid air-distribution member cooperating with said four side edges and said planar base member to create a vacuum chamber, said air-distribution member including a pattern of apertures extending therethrough;

(iii) an array of raised pedestals of equal height extending outwardly from said air-distribution member to define interconnected channels leading from the periphery of said air-distribution member to said pattern of apertures, said array of pedestals adapted to support a perforated abrasive sheet member thereon;

(b) an elongated tubular pole having an open end and a closed end and joined to said planar base member of said sanding head by a universal joint disposed at said closed end and with first and second diametrically opposed side ports extending through the wall of said tubular pole a predetermined distance proximal of said closed end; and (c) a pair of flexible hoses coupled individually and bilaterally symmetrically relative to said planar base member between said first and second side ports and said first and second vacuum ports, said pair of flexible hoses being sufficiently rigid to restrict free movement of said base member relative to said tubular pole while allowing pivoting of said sanding head relative to said pole about two mutually perpendicular axes when said sanding head is pushed with a predetermined force against a surface to be sanded, the arrangement being such that a source of vacuum coupled to said open end of said tubular pole creates a relatively uniform negative pressure within said vacuum chamber.

2. The sanding apparatus as in claim 1 and further including clamp means on said base member for removably securing said abrasive sheet in position on said array of pedestals.

3. The sanding apparatus as in claim 2 wherein said clamp means includes a sheet of spring steel secured to the outer surface of said base member proximate opposed end edges thereof and normally biased against said outer surface, and lever means for lifting said sheet allowing a portion of said abrasive sheet to be inserted in between said sheet and said outer surface of said base member.

4. The sanding apparatus as in claim 1 wherein said universal joint includes a tubular sleeve dimensioned to telescopingly receive said elongated pole and having a pair of mutually perpendicular pivot axes affixed to said tubular sleeve and to said base member to allow the angle between said sleeve and said base member to be continuously adjustable over a predetermined range.

5. The sanding apparatus as in claim 1 wherein dust developed during a sanding operation is drawn through said channels and said pattern of apertures into said vacuum chamber and thence through said flexible hoses and said tubular pole to said source of vacuum.

6. The sanding apparatus as in claim 5 wherein said universal joint is outside of said vacuum chamber and not exposed to the flow of dust.

* * * * *